US007435708B2

(12) United States Patent
Lopes

(10) Patent No.: US 7,435,708 B2
(45) Date of Patent: Oct. 14, 2008

(54) LUBRICANT COMPOSITION

(76) Inventor: John A. Lopes, 2209 Niagara Dr., Troy, MI (US) 48083

( * ) Notice: Subject to any disclaimer, the term of this patent is extended or adjusted under 35 U.S.C. 154(b) by 442 days.

(21) Appl. No.: 11/020,608

(22) Filed: Dec. 22, 2004

(65) Prior Publication Data

US 2005/0107267 A1 May 19, 2005

Related U.S. Application Data

(63) Continuation-in-part of application No. 10/657,902, filed on Sep. 9, 2003, now Pat. No. 6,953,772.

(51) Int. Cl.
*C10M 141/10* (2006.01)
*C10M 159/00* (2006.01)

(52) U.S. Cl. ..... 508/459; 508/162

(58) Field of Classification Search ..... 508/459, 508/162

See application file for complete search history.

(56) References Cited

U.S. PATENT DOCUMENTS

| | | | | | |
|---|---|---|---|---|---|
| 4,945,110 | A | * | 7/1990 | Brokken et al. | 514/517 |
| 5,174,914 | A | * | 12/1992 | Gutzmann | 508/410 |
| 5,280,042 | A | * | 1/1994 | Lopes | 514/557 |
| 5,843,873 | A | * | 12/1998 | Butke et al. | 508/185 |
| 5,863,874 | A | * | 1/1999 | Person Hei et al. | 508/521 |
| 5,900,392 | A | * | 5/1999 | Bernhard | 508/154 |
| 5,942,478 | A | * | 8/1999 | Lopes | 510/130 |

* cited by examiner

*Primary Examiner*—Glenn Caldarola
*Assistant Examiner*—Jim Goloboy
(74) *Attorney, Agent, or Firm*—The Weintraub Group, PLC

(57) ABSTRACT

The invention teaches the preparation of a concentrated sanitizing, cleaning and lubricating preparation. The preparation has a dual use for cleaning, sanitizing as well as lubricating beverage conveyors. The composition of the invention shows rapid microbicidal properties against representative gram positive and gram-negative bacteria. The invention uses GRAS, food additive ingredients and/or ingredients that are approved by the US FDA for use on food.

2 Claims, No Drawings

LUBRICANT COMPOSITION

CROSS-REFERENCE TO RELATED APPLICATIONS

This application is a continuation-in-part of U.S. patent application No. 10/657,902, filed on Sep. 9, 2003, now U.S. Pat. No. 6,953,772 for "CONCENTRATED SANITIZING COMPOSITIONS FOR CLEANING FOOD AND FOOD CONTACT SURFACES," the disclosure of which is hereby incorporated by reference, which in turn is a continuation-in-part of U.S. application Ser. No. 09/908,527, filed Jul. 18, 2001, which, in turn, is related to U.S. patent application Ser. No. 60/219,256, which was filed on Jul. 18, 2000.

BACKGROUND OF THE INVENTION

1. Field of the Invention

The present invention pertains to lubricant compositions. More particularly, the present invention pertains to lubricant and cleaning compositions for use on food stuffs. Even more particularly, the present invention pertains cleaning and sanitizing compositions which enhance and which provide lubricity and which are safe for use on food stuffs and in food and beverage handling environments.

2. Prior Art

In the above-referred to co-pending application, the disclosure of which is hereby incorporated by reference, there is disclosed a cleaning and sanitizing, as well as, lubricating composition for use in cleaning food stuffs and food-contacting surfaces and which is safe for use on food handling. In other words, the composition while being a cleaning composition, also, can act as a lubricant when used with food handling equipment.

According to the co-pending application, the composition thereof, generally, comprises a mixture of acids, namely, citric acid and lactic acid and a surfactant.

The three-component system thereof, while being efficacious, still has a cost effectiveness problem associated therewith because of the need for the three components.

Thus, it would be most beneficial if a two-component system would be provided based upon the technology of the above-referred to co-pending application with the concomitant reduction in cost.

It is to this to which the present invention is directed.

SUMMARY OF THE INVENTION

In accordance with the present invention there is provided a lubricating composition which, additionally, cleans sanitizes which, generally, comprises an admixture of: an acidifying agent and an anionic surfactant. More particularly, the present invention comprises:

(a) an acidifying agent which is present either as an individual acid, preferably benzoic acid, or as a mixture of acids of at least benzoic acid along with citric acid, phosphoric acid or a mixture thereof, the acidifying acids being classified as GRAS or suitable for use as food additive by the US FDA; and (b) an anionic surface selected from chemicals classified as GRAS or suitable for use as food additive by the US FDA.

The composition of the present invention may also include at least one carrying agent compatible with the aforementioned compounds. The carrying agent typically functions as a suitable diluent and is present in liquid, powder or gel form to dissolve, disperse or suspend the above aforementioned ingredients.

The composition may include other compatible ingredients, which do not reduce or interfere with the lubricating and antimicrobial and cleaning properties. Certain ingredients such as organic and inorganic salts, urea, etc. which may enhance the cleaning properties, may also be incorporated. The composition may additionally include compounds from among coloring agents, antioxidants, fragrances, vitamins, nutritive agents and thixotropic agents as well as any combination of the above. For a more complete understanding of the present invention, reference is made to the following detailed description and accompanying illustrative examples.

DETAILED DESCRIPTION OF THE PREFERRED EMBODIMENT

The cleaning lubricating and sanitizing composition of the present invention may be employed in either a concentrated composition or in a ready-to-use formulation. The lubricant composition contains:

(a) an acidifying agent, which is at least benzoic acid, alone or an admixture with either lactic acid, phosphoric acid or a mixture thereof; and (b) an anionic surfactant The acidifying agent and surfactant are each selected from chemical compounds which are classified as GRAS or suitable for use as food additive by the US FDA or, at minimum, approved for use on food-contacting surfaces.

The acidifying agent is at least benzoic acid, alone or in admixture with one compound selected from lactic acid, phosphoric acid or both. Other useful acids which may be in admixture with the benzoic acid or the mixture of benzoic with the lactic and/or phosphoric acid include adipic acid, malic acid, sorbic acid, succinic acid, tannic acid, tartaric acid, sulfuric acid, nitric acid, hydrochloric acid, sulfamic acid, carboxylic acid polymers, homo- or hetero-polymerized alpha hydroxycarboxylic acid such as polylactic acid or polylactic-glycolic acid and mixtures of two or more of said acids.

Other useful acids which may be used conjointly with the benzoic acid include acetic, ascorbic, citric, dehydroacetic, erythrobic, fumaric, glutaric, gluconic, hyaluronic, glycolic, lactic, malic, sulfamic, as well as mixtures of two or more of these acids.

While it is preferred that the acidifying agent be a single compound of benzoic acid, where the acidifying agent is a combination of benzoic with lactic or phosphoric with one or more of the other aforementioned acids, they are present in ratios and concentrations which is sufficient to provide a pH in the resulting use solution of below 5. Where two or more acids are employed in combination with another, the preferred combinations are those which include at least one benzoic acid with one acid from the group including lactic and phosphoric together with at least one of the other above-listed acids. In such instances it is preferred that the acidifying agent constitute 10% to 60% of the concentrate composition. It is generally preferred that between 0.002% and 40% of the acidifying component of the composition be benzoic acid. When used as a single acidifying agent, the concentration of benzoic acid (88%) can be up to 95% of the concentrate composition with between 0.002% and 95% being preferred. In the most preferred embodiment, the acidifying agent used in the composition includes benzoic acid with lactic acid or phosphoric acid and, optionally, citric acid. Where the composition is benzoic acid with either lactic and/or phosphoric, the components are present in a respective weight by volume ratio of 3.5 to 5.0:20 or 3.5 to 5.0:5.0.

Where a mixture of all four acids is employed, the weight by volume ratio is, usually benzoic acid (100%) to phosphoric acid (75%) to lactic acid (88%) to citric acid (100%), of 3.5 to 5.0:20:5.0:5.0.

Both lactic acid and phosphoric acid can be used to lower the pH. Lactic acid, additionally, imparts solubilizing properties for incorporating higher concentrations of anionic agents to prepare concentrated the sanitizing lubricant compositions. Thus, weight ratios of phosphoric to lactic acid varying from 0% to 40% of phosphoric acid with 0% to 60% lactic acid along with the benzoic acid are used to prepare concentrated sanitizers using anionic agents. Phosphoric acid is a stronger acid and can be used at lower concentration than lactic acid to lower the pH, which offers economic advantage to the formulation. Lactic acid on the other hand solubilizes higher concentrations of anionic agents. Lactic acid is used in lubricating sanitizing compositions where anionic surface-active agents are hydrolyzed by phosphoric acid.

The anionic surface active agents or surfactant can be selected from active and/or emulsifying agents classified by the US FDA as generally regarded as safe (GRAS) and/or classified as food additive, and/or allowed for use on food products and food contact surfaces as those terms are defined by the United States Food and Drug Administration in the Code of Federal Regulations, Chapter 21, Parts 178, 184, and 186 or which have low toxicity and have been approved for specific uses by applicable regulatory agencies. These surfactants and/or emulsifying agents include free acid forms or salt forms (e.g. the ammonium, sodium potassium, calcium and magnesium salts) of anionic surfactants having at least one hydrophobic group. The hydrophobic group contemplated herein consists of substituted or unsubstituted-alkyl, n-alkenyl, -alkylbenzyl, or alkyl (monomethyl and dimethyl) naphthalene groups with the length of alkyl/alkenyl chains equivalent to 6 to 16 carbon atoms. The surfactant also includes at least one hydrophilic group from the group containing monocarboxylic acid, dicarboxylic acid, sulfate, sulfonate, phosphate and phosphonate groups as well as combinations of these groups.

Thus, the surfactant/emulsifying materials which are contemplated for use herein include:

(a) $C_6$-$C_{16}$ alkyl- and alkenyl sulfonates;

(b) $C_6$-$C_{16}$ alkyl- and alkenyl ether sulfates;

(c) $C_6$-$C_{16}$ alkyl diphenyl ether disulfonates;

(d) dialkyl- and dialkenyl sulfosuccinates in which the alkyl or alkenyl groups independently contain from six to sixteen carbon atoms;

(e) alkyl benzene sulfonates in which the alkyl group contains from six to sixteen carbon atoms;

(f) napthalenesulfonates;

(g) alkylnapthalenesulfonates in which the alkyl group contains from one to six carbon atoms;

(h) the mono- (n-alkyl) and mono (n-alkenyl) acyl esters of $C_2$-$C_4$ hydroxylated monocarboxylic acids, in which the alkyl or alkenyl group contains from six to sixteen carbon atoms;

(i) the mono- (n-alkyl) and mono (n-alkenyl) acyl esters of $C_2$-$C_4$ hydroxylated dicarboxylic acids, in which the alkyl or alkenyl group contains from six to sixteen carbon atoms;

(j) the mono- (n-alkyl) and mono (n-alkenyl) alkyl esters of $C_2$-$C_4$ dicarboxylic acids, in which the alkyl or alkenyl group contains from six to sixteen carbon atoms; and (k) $C_4$-$C_{16}$ fatty alcohol sulfoacetates.

By the term "alkyl" as used throughout this specification and the appended claims is meant a monovalent straight or branched chain hydrocarbon radical which can be thought of as derived from a saturated acyclic hydrocarbon by removal of one hydrogen atom. By the term "alkenyl" is meant a monovalent hydrocarbon radical containing one or more carbon-carbon double bonds, which radical can be thought of as being derived from an unsaturated acyclic hydrocarbon by the removal of one hydrogen atom.

The term "salt of a mono (n-alkyl) and mono (n-alkenyl) acyl esters of $C_2$-$C_4$ hydroxylated monocarboxylic acid" means an ester salt of hydroxylated monocarboxylic acid, such as lactic acid, which has been formed by esterification of its hydroxyl function by another acid, and in which its carboxyl function has been converted to a carboxylate salt. An example of such a compound is so-called "decyl lactylate" which is the ester formed by esterifying the hydroxyl group of lactic acid with decanoic acid, and converting the carboxyl function of the lactic acid portion of the resulting ester to the carboxylate salt form.

Similarly, the term "salt of a mono (n-alkyl) and mono (n-alkenyl) acyl esters of $C_2$-$C_4$ hydroxylated dicarboxylic acid" means an ester salt of hydroxylated discarboxylic acid, such as hydroxymalonic acid, which has been formed by esterification of its hydroxyl function by another acid, and in which its two carboxyl functions have been converted to a carboxylate salts.

By the term "salt of a mono (n-alkyl) and mono (n-alkenyl) acyl esters of $C_2$-$C_4$ hydroxylated dicarboxylic acid" is meant an ester salt of dicarboxylic acid, such as succinic acid, which has been formed by esterification by an alcohol at one hydroxyl group.

Preferred anionic agents for the composition of the present invention include free acids or ammonium, sodium, calcium, potassium, or magnesium salts of 1) alpha olefin ($C_{14}$-$C_{16}$) sulfonic acid; 2) $C_4$-$C_{16}$ fatty acid isethionic acid; 3) $C_4$-$C_{16}$ fatty alcohol sulfoacetic acid; 4) decyl lactylic acid; 5) lauryl sulfuric acid; and 6) 1,4-dihexyl sulfosuccinic acid.

The surface-active agent is preferably selected from alkali salts of ($C_6$-$C_{16}$) n-alkylbenzene sulfonic acids, ($C_6$-$C_{16}$) n-alkylbenzene sulfonic acids and ($C_6$-$C_{16}$) n-alkenyl sulfonic acids. The surface-active agent may include any one of the aforementioned compounds either alone or in combination. The most preferred surface-active agents are sodium dodecylbenzene sulfonate, sodium diioctyl sulfosuccinate, sodium decyl lactylate, sodium alpha olefin sulfonate, as well as mixtures thereof. The concentration of the surface-active agent is selected from 0.001% to 50%. The most preferred concentration of the surface-active agent is between 4% and 6.4% of the concentrate on a weight basis.

These preferred anionic agents include sodium dodecyl sulfate, sodium dioctyl suslfosuccinate, sodium decyl lactylate, sodium dodecyl benzene sulfonate, and sodium alpha olefin sulfonate are either regarded as secondary food additives as per Code of Federal Regulations (CFR 21) or are exempted from tolerance requirement under (CFR 40:180:0001) when present in chemical products used in or on all raw agricultural commodities after harvest cause no hazard to public health.

The concentration of the surfactant in the lubricant composition of the present invention is broadly defined as that sufficient to maintain the various components thereof in suitable solution. The surfactant is generally present in an amount between about 0.0001% to about 50% by composition weight. The most preferred concentration of the surface-active agent is between 4.0% and 6.4% by weight.

The anionic and/or emulsifying agents may be used in concentrations ranging from about 10 ppm to about up to 200,000 ppm. The anionic surfactant can be used as a single molecular species or in combination with other anionic and/or noninonic/cationic/amphoteric molecular species.

The sanitizing and antimicrobial lubricant composition of the present invention may also contain at least one sequestering or chelating agent. As used herein the terms "sequestering" and "chelating" are used interchangeably to mean a compound which, among other functions, will act to reduce cloudiness or turbidity which might otherwise result when the compositions are dissolved or admixed in hard water. Components which may be employed for these purposes include organic compounds such as citric acid, ethylene diamine tetracetic acid (EDTA), as well as organic salts thereof such as calcium citrate, calcium diacetate, isopropyl citrate, monoisopropyl citrate, potassium citrate, sodium citrate, stearyl citrate, and sodium gluconate. Components may also include inorganic compounds sodium acid phosphate, calcium hexametaphosphate, sodium phosphate, sodium pyrophosphate, tetrasodium pyrophosphate, sodium tripolyphosphate. Materials suitable for use in the composition of the present invention are those chemicals classified as GRAS or as suitable for food additives by the US FDA.

The sequestering agent, preferably, is selected from at least one of the following: citric acid, sodium acid pyrophosphate and EDTA with the most preferred sequestering agent being sodium acid pyrophosphate. The concentration of sequestering agent in the concentrate is contemplated between 2% and 10% by weight with the most preferred concentration being between 4% and 6% by weight.

Suitable carriers or solubilizers are selected from water and/or various alcohols such as ethyl and propyl alcohols or glycols or a mixture thereof. Water, ethyl alcohol, and propylene glycol are preferred solubilizing agents with water being the most preferred solubilizer. The concentration of water is selected from 10% to 80% w/w. The most preferred concentration is between 50% to 70%.

The composition may include additional emulsifying or surface-active agents such as lecithin, polysorbate 60, polysorbate 65, polysorbate 80, sucrose fatty acid esters, salts of stearoyl 2-lactylate and other agents classified as food additive or GRAS by the US FDA.

As indicated previously, the present invention contemplates the production of a lubricant composition, which can be used on both food, as well as food contact surfaces and beverage lines, including brewery lines, to clean and sanitize the target surface.

The composition is prepared by first mixing together the liquid ingredients such as lactic acid or phosphoric acid and water. The solid ingredient(s) are then dissolved in the solution to make the final composition.

The sanitizing hereof evidences its lubricating properties by enabling reduction of frictional properties between two surfaces. Incorporating natural gums, synthetic polymers, certain esters, or other ingredients with high molecular weights that impart rheological properties to the sanitizer composition, can further enhance its lubricating properties. Optional compounds bearing negative and/or positive charges, which reduce friction by adsorbing onto the surfaces, can also be incorporated in a sanitizing lubricating composition. Thus the sanitizer composition can be used as sanitizing lubricant in food and beverage processing plants.

Additionally, by incorporating foaming and defoaming agents, the foaming properties of the lubricant composition can be modulated depending on the application.

A concentrated lubricant composition prepared with certain anionic agents such as sodium alpha olefin sulfonate does not require chelating agents to counteract haziness or precipitate produced by water hardness when preparing use solution with hard water. Thus the present composition preparation is rendered more economical.

To this basic composition various lubricating ingredients are added that do not cloud or interact but enhance lubricating properties by reducing friction and increase the load bearing capacity of the lubricant for use on metallic as well as plastic or cellulosic containers. Thus the composition may incorporate suitable concentrations of anti-corrosive agents, antimicrobial agents, viscosity modulating ingredients, thixotrophic agents, solubilizing agents, coloring agents, anti-foaming agents, fragrances, chelating agents, surface active modifying agents, solvating agents, anti-freezing agents, other surfactants, polymers, hydrotropes, and other suitable ingredients. These include ether diamines and/or dicarboxylic acids, mono- and di-carboxylic acid esters, alkali metal salts of alkyl naphthalene sulfonate, xylene sulfonate, cumene sulfonate, alkyl polyglucoside, glycerol and propylene glycol; polyalkylene glycols, polyethylene and methoxypolyethylene glycols, linear copolymers of ethylene and propylene oxides, and sorbitan esters, phosphate esters, amines and their derivatives and mixtures thereof.

A concentrated lubricant composition can be diluted from 1:100 to 1:800 for spraying on the conveyor system for reducing friction and preventing precipitate or microbial or slime build up.

The lubricating compositions according to the present invention exhibit excellent lubricating properties and combines superb sanitizing properties to inhibit microbial growth and displays hard water tolerance. Properly diluted lubricant composition does not show floor build up of slippery lubricant. The antimicrobial properties are imparted by acidifying system below pH 7.0.

A particularly preferred lubricating concentrate is formulated with an acidifying system of pH below 7.0. comprising benzoic, phosphoric and lactic acid in the ratio of 0.01%-10% of benzoic acid: 0.01%-60% phosphoric acid: 0.0%-60% lactic acid w/w and an anionic surface active agent present in an amount ranging from 0.01% to 50% w/w.

The lubricating composition hereof may have other agents or ingredients that enhance lubricating, stabilizing, anti-corrosive, thixotropic, penetrating, and other synergistic properties added thereto. Thus the composition may incorporate suitable concentrations of anti-corrosive agents, antimicrobial agents, viscosity modulating ingredients, thixotrophic agents, solubilizing agents, coloring agents, anti-foaming agents, fragrances, chelating agents, surface active modifying agents, solvating agents, anti-freezing agents, other surfactants, polymers, hydrotropes, and other suitable ingredients. These include ether diamines and/or dicarboxylic acids, mono- and di-carboxylic acid esters, alkali metal salts of alkyl naphthalene sulfonate, xylene sulfonate, cumene sulfonate, alkyl polyglucoside, glycerol and propylene glycol; polyalkylene glycols, polyethylene and methoxypolyethylene glycols, linear copolymers of ethylene and propylene oxides, and sorbitan esters, phosphate esters, amines and their derivatives and mixtures thereof.

The embodiment of the invention is illustrated by following examples, which are illustrative and not to be construed as limitative of the scope of the present invention.

For a more complete understanding of the present invention reference is made to the following illustrative, non-limitative examples. In the examples all parts are by weight absent contrary indications.

EXAMPLE 1

A lubricant according to the disclosure of the present invention was prepared by mixing together at ambient conditions, the following compounds and concentrations as set forth in Table 1:

TABLE 1

COMPOSITION FOR CLEANING FOOD SURFACES

| Ingredient | Amount, pbw |
|---|---|
| Lactic acid 88% | 32.0 |
| Phosphoric acid 75% | 13.0 |
| Citric acid (powder) | 6.4 |
| Sodium acid pyrophosphate | 5.0 |
| Sodium dodecylbenzene sulfonate | 5.0 |
| Water | 57.0 |

The pH of the composition in Example 1 was 2.3 when diluted in the ratio of 0.78:100 v/v with municipal tap water. The concentration of sodium dedecylbenzene sulfonate is 400 ppm in the dilute solution.

The preparation was tested for stability at 4° C. and did not show any precipitate or turbidity after 30 days at 4° C.

The sanitizing and disinfecting efficacy of the dilute aqueous lubricant solution of Example 1 was evaluated using the procedure of Method No. 6 from the 13$^{th}$ Edition of the *Official Methods of Analysis of the A.O.A.C.,* 1111 North 19$^{th}$ Street, Alexandria, Va. 22209. The composition in Example 1 was tested for bactericidal properties essentially by the modified A.O.A.C. (Association of Analytical Chemists) germicidal and detergent sanitizer test using *Staphylococcus aureus* ATCC 6538 and *Escherichia coli* ATCC 11229 (Lopes 1986, J. of Dairy Sci. 69:2791-2796).

One milliliter of the bacterial suspension was added to 99 ml of the test solution containing 1 ml of the composition in Example 1 and 500 ppm of synthetic water hardness. After contact time of 30 seconds and 60, 1 milliliter of the test mixture was rapidly mixed with neutralizing solution to stop microbicidal activity of the test solution. One milliliter and 0.1 milliliter of the neutralized mixture were plated by the pour plate method using brain heart infusion agar for bacterial count. Control consisted of sterile water (with 500 ppm of synthetic water hardness) instead of the test solution. The results are presented in the following tables.

The control was subjected to serial ten fold dilutions to obtain a readable number of bacteria count in the challenge. Table 2 shows the bactericidal properties of the compositions after 30 seconds and 60 seconds contact time against both *Staphylococcus aureus* and *E. coli*, the representative bacteria for gram positive and negative group respectively.

The results in Table 2 demonstrate that the composition of Example 1 has microbicidal properties against both gram negative and gram-positive test bacteria.

TABLE 2

MICROBICIDAL PROPERTIES AGAINST *STAPHYLOCCUS AUREUS* OF COMPOSITION IN EXAMPLE 1

| | Bacterial Type | | | |
|---|---|---|---|---|
| | *Staphylococcus aureus* | | *Escherichia coli* | |
| | Number of surviving bacteria after contact (cfu/ml) | | | |
| Contact time | 30 seconds | 60 seconds | 30 seconds | 60 seconds |
| Vol. of neutralized test mixture plated | 1.0 ml | 1.0 ml | 1.0 ml | 1.0 ml |
| | 0, 0 | 0, 0 | 0, 0 | 0, 0 |
| Dilution) | Challenge No of bacteria (cfu/ml) | | Challenge No of bacteria (cfu/ml) | |
| $10^{-6}$ | T, T | | T, T | |
| $10^{-7}$ | 216, 259 | | 280, 365 | |
| $10^{-8}$ | 18, 0 | | 19, 26 | |

(*T = Too numerous to count. CFU = colony forming unit)

EXAMPLE 2

A series of lubricating sanitizer compositions were prepared from varying ratios of lactic acid and phosphoric acid along with benzoic acid. The following table, Table 3, sets forth the ingredients and amounts.

TABLE 3

| | Composition, amount, pbw | | |
|---|---|---|---|
| Ingredients | A | B | C |
| Sodium alpha olefin sulfonate (80%) | 15.00 | 40.00 | — |
| Lactic acid (88%) | 40.00 | 40.00 | 27.03 |
| Phosphoric acid (75%) | 10.00 | 15.00 | 10.98 |
| Lauryl lactylate | 10.00 | 5.00 | — |
| Pluronic F88 Prill (BASF)[1] | 10.00 | — | — |
| Benzoic acid | 5.00 | 5.00 | — |
| Sodium acid pyrophosphate | — | — | 4.22 |
| Sodium alkyl benzene sulfonate | — | — | 4.22 |
| Water | 25.00 | 10.00 | 53.55 |

[1]A nonionic surfactant sold by BASF under the name PLURONIC F-88, Prills used to increase the foam.

EXAMPLE 3

This example illustrates the preparation of a lubricant containing food grade or generally regarded as safe components in accordance herewith.

At room temperature and with stirring there is prepared a 100 ml volume of liquid lubricant by mixing together in a suitable vessel the following ingredients:

In concentrated form the composition of invention can be used for continuous dilution with water with automatic dispensing systems. The cleaning solution can be reconstituted with water just prior to use from its concentrated form. The composition of invention can be used for cleaning both food and non-food inanimate surfaces.

In conclusion, the composition embodied in the invention is useful for lubricating beverage manufacturing surfaces, such as conveyors, thus rendering such beverages safer for consumption. Dual use of the invention as both a lubricant and cleaner-sanitizer reduces inventory of chemical cleaners and sanitizers and saves money in transportation and storage. Automatic metering of the concentrated liquid form enables to avoid the risks of manual handling.

Having, thus, described the invention, what is claimed is:

What is claimed is:

1. A lubricating composition having microbicidal and cleaning properties for use on beverage conveyors, comprising:

(a) an acidifying agent which is a mixture of benzoic acid, lactic acid, and phosphoric acid;

(b) at least one anionic surface active agent, and (c) sodium acid pyrophosphate as a sequestering agent, the sodium acid pyrophosphate being present in an amount between 2% and 10% w/w.

2. A lubricating composition having microbicidal and cleaning properties for use on beverage conveyors, comprising:

(a) an acidifying agent which is a mixture of benzoic acid, lactic acid, and phosphoric acid;

(b) at least one anionic surface active agent which is at least one compound selected from the group including salt or acid forms of anionic surfactants with at least one hydrophobic group and at least one hydrophilic group, the at least one compound being selected from the group consisting of sodium dodecylbenzene sulfonate, sodium alpha olefin sulfonate, sodium dioctyl sulfosuccinate, sodium decyl lactylate and mixtures thereof, and wherein the ingredients are generally regarded as safe and/or allowed by the US FDA for use on food, the composition being at a pH of pH 5.0 or below.

* * * * *